US010654647B2

(12) United States Patent
Chakravarthy et al.

(10) Patent No.: US 10,654,647 B2
(45) Date of Patent: May 19, 2020

(54) FILM CASSETTE HAVING AN OVOID SHAPE

(71) Applicant: Edgewell Personal Care Brands, LLC, Chesterfield, MO (US)

(72) Inventors: Sumanth Chakravarthy, Stamford, CT (US); Alexander Chenvainu, Mahwah, NJ (US); Neil MacDonald, Naugatuck, CT (US)

(73) Assignee: Angelcare USA, LLC, Newark, DE (US)

( * ) Notice: Subject to any disclaimer, the term of this patent is extended or adjusted under 35 U.S.C. 154(b) by 255 days.

(21) Appl. No.: 15/417,491

(22) Filed: Jan. 27, 2017

(65) Prior Publication Data

US 2017/0233182 A1 Aug. 17, 2017

Related U.S. Application Data

(60) Provisional application No. 62/288,046, filed on Jan. 28, 2016.

(51) Int. Cl.
*B65F 1/06* (2006.01)
*B65F 1/16* (2006.01)

(52) U.S. Cl.
CPC ..... *B65F 1/062* (2013.01); *B65F 1/163* (2013.01); *B65F 2210/1026* (2013.01); *B65F 2210/167* (2013.01); *B65F 2240/132* (2013.01)

(58) Field of Classification Search
CPC ..... B65F 1/062; B65F 2210/1026; B65F 2210/167; B65F 2240/132; B65F 1/163; B65F 1/06; B65F 1/068; B65F 1/0006; B65F 1/10; B65F 1/00; B65F 2210/1675; B65F 2210/132; B65F 1/1415; B65F 1/067; B65F 1/065; B65D 85/08; B65D 85/04; B65H 49/02; B65B 9/00; B65B 43/02; A47K 11/026; B60N 3/08; Y02A 50/454
USPC ..... 206/554, 495.06, 495.08, 303, 324; 220/495.07, 908, 908.1, 324, 315
See application file for complete search history.

(56) References Cited

U.S. PATENT DOCUMENTS

| | | | |
|---|---|---|---|
| 4,519,104 | A | 5/1985 | Klintland |
| 5,651,231 | A | 6/1997 | Garland |
| 5,765,339 | A | 6/1998 | Garland |
| 6,851,251 | B2 | 2/2005 | Stravitz |
| 7,146,785 | B2 | 12/2006 | Stravitz |
| 7,316,100 | B2 | 1/2008 | Stravitz et al. |

(Continued)

FOREIGN PATENT DOCUMENTS

| | | | |
|---|---|---|---|
| FR | 2811650 | A1 | 1/2002 |
| JP | H0639804 | U | 5/1994 |

OTHER PUBLICATIONS

International Search report of PCT/US17/15273, dated Apr. 5, 2017.

(Continued)

*Primary Examiner* — Robert J Hicks
(74) *Attorney, Agent, or Firm* — Norton Rose Fulbright US LLP

(57) ABSTRACT

A cassette for a waste disposal device is provided having a length of tubular liner film. The cassette has a central passage. The cassette has a forward edge, an aft edge, a first edge and a second edge defining a shape and a widthwise axis and a depthwise axis. The depthwise axis and widthwise axis intersect form two segments of each axis.

18 Claims, 10 Drawing Sheets

(56) References Cited

U.S. PATENT DOCUMENTS

| | | | | |
|---|---|---|---|---|
| 7,434,377 | B2 | 10/2008 | Stravitz et al. | |
| 7,503,152 | B2 | 3/2009 | Stravitz et al. | |
| 7,503,159 | B2 | 3/2009 | Stravitz et al. | |
| 7,594,376 | B2 | 9/2009 | Chomik | |
| 7,617,659 | B2 | 11/2009 | Stravitz et al. | |
| 7,694,493 | B2 | 4/2010 | Stravitz et al. | |
| 7,696,711 | B2 | 4/2010 | Pollack et al. | |
| 7,708,188 | B2 | 5/2010 | Stravitz et al. | |
| 7,712,285 | B2 | 5/2010 | Stravitz et al. | |
| 7,958,704 | B2 | 6/2011 | Stravitz et al. | |
| 2003/0121923 | A1 | 7/2003 | Morand et al. | |
| 2003/0131569 | A1 | 7/2003 | Chomik et al. | |
| 2005/0193692 | A1 | 9/2005 | Stravitz et al. | |
| 2006/0130438 | A1 | 6/2006 | Stravitz et al. | |
| 2012/0091295 | A1* | 4/2012 | Morand | B65B 67/1222 248/99 |
| 2014/0110293 | A1* | 4/2014 | Dunn | B65F 1/062 206/389 |
| 2015/0164293 | A1 | 6/2015 | Shimanuki et al. | |

OTHER PUBLICATIONS

International Search Report of PCT/US17/15288, dated Apr. 5, 2017.

* cited by examiner

FILM CASSETTE HAVING AN OVOID SHAPE

CROSS-REFERENCE TO RELATED APPLICATIONS

This application claims priority to U.S. Provisional Application Ser. No. 62/288,046, filed Jan. 28, 2016, the entirety of which is incorporated herein.

BACKGROUND OF THE INVENTION

1. Technical Field

The present disclosure relates to an apparatus for packaging disposable material or objects into a tubular flexible plastic film material in general, and to cassettes for providing the tubular flexible plastic film material in particular.

2. Background Information

Waste disposal devices that include a cassette are commonly used to throw away odorous waste, such as diapers and litter. In such waste disposal devices, the cassettes are supported at an opening of a bin and have a length of tubular film and/or dispense a tubular film projecting into the inner cavity of the bin of the waste disposal device. The free end of the tubular film can be closed to define a bag-like structure. Often, the waste disposal device includes an internal mechanism that closes the bag shut (e.g., by clamping, twisting, etc.), thereby isolating the waste in the bag below the internal mechanism, and capturing the odors in the bag.

However, the cassettes are costly for the consumer, whereby it is desired to increase the amount of tubular film per cassette, without increasing drastically the dimensions of the cassette, for instance to be compatible with existing formats of waste disposal devices. By increasing the quantity of bag per cassette for similar dimensions, the transportation costs and shelving costs may also be reduced. By modifying the geometry of the cassette without drastically changing the dimensions of the cassette, a further benefit can be provided during insertion of waste.

SUMMARY OF THE APPLICATION

According to an aspect of the present disclosure, a cassette for a waste disposal device is provided. The cassette defines a central passage has a perimeter having a forward edge, an aft edge, a first side edge, a second side edge, a widthwise axis perpendicular to a depthwise axis. The widthwise axis extends at a maximum distance A between the first and second side edges, and the depthwise axis extends at a maximum distance B between the forward edge and the aft edge, where B is greater than A. The widthwise axis is separated from the forward edge by a distance C, and the widthwise axis is separated from the aft edge by a distance D, where D is greater than C. The cassette has a liner cavity defined by the central passage such that the liner cavity is outward of the central passage. Alternatively, the cassette has a length of film attachable to the cassette. In some embodiments, the film is attached such that it extends from the central passage.

According to another aspect of the present disclosure, a cassette for a waste disposal device is provided. The cassette has an outer edge having a perimeter that interfaces with a waste disposal waste disposal device. The central passage has a forward edge, an aft edge, a first side edge, a second side edge, a widthwise axis perpendicular to a depthwise axis. The widthwise axis extends at a maximum distance A between the first and second side edges, and the depthwise axis extends at a maximum distance B between the forward edge and the aft edge, where B is greater than A. The widthwise axis is separated from the forward edge by a distance C, and the widthwise axis is separated from the aft edge by a distance D, where D is greater than C. The cassette has a liner cavity defined by the outer edge such that the liner cavity is inward of the central passage. Alternatively, the cassette has a length of film attachable to the cassette. In some embodiments, the film is attached such that it extends from the outer edge.

In a further aspect of the present disclosure, a cassette for a waste disposal device includes both an outer edge and an inner edge, where the inner edge defines the central passage. In some embodiments, the outer edge and central passage define the periphery of a liner cavity storing film in a folded or pleated manner. In further embodiments, the outer edge and/or central passage may define a surface such as a wall or have more than de minimis thickness. In further embodiments, an edge may be a top surface edge. The present disclosure is described herein in terms of aspects and embodiments of those aspects that include elements or features that may be included with the aspects. The identified embodiments may be included with the aspect of the invention singularly or in combination with any of the other identified embodiments as will be described herein below in the Detailed Description. The features and advantages of the present invention will become apparent in light of the detailed description of the invention provided below, and as illustrated in the accompanying drawings.

DETAILED DESCRIPTION

Figure 1:
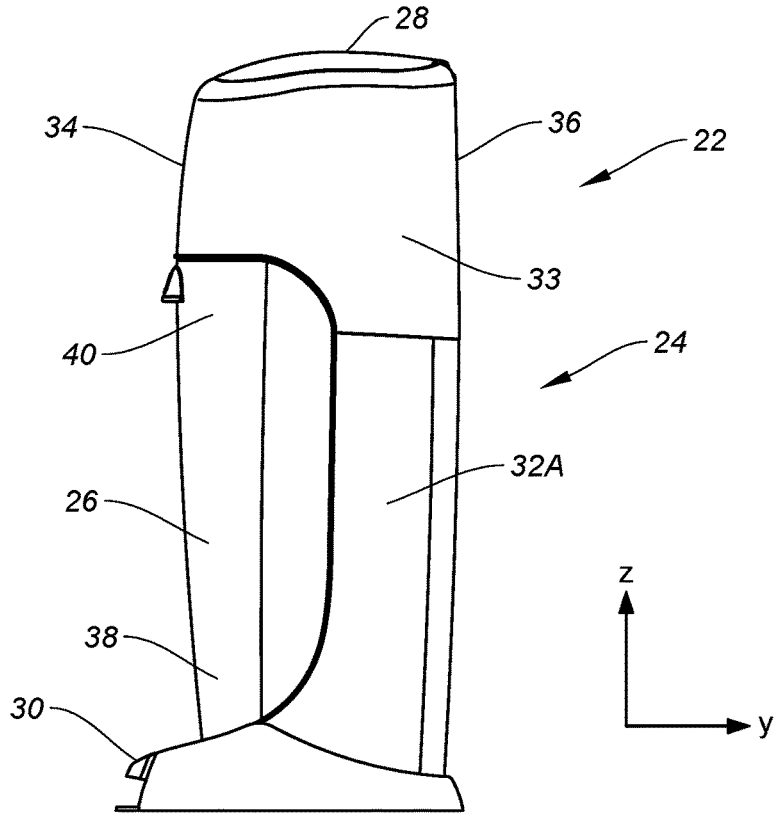
FIG. 1 is a side perspective of a waste disposal device.

Referring now to the drawings, a cassette 20 (see FIGS. 4-6) for use in a waste-disposal device 22 (see FIGS. 1-3) is provided. A "cassette" 20 is defined as any of multiple embodiments, including embodiments where the film is at least partially stored within the cassette and/or is attached to the cassette and forms a bag-like structure. All of the cassette embodiments include a central passage 48 through which waste is passed. The waste disposal device 22 and the cassette 20 may be used for storing any type of waste items, but are well suited for the disposal of diapers. The present cassette 20 may be used with a variety of different types of waste-disposal devices, and therefore is not limited to any particular type of waste-disposal device. To facilitate the description of the present cassette 20, an exemplary non-limiting embodiment of a waste disposal device 22 with which the present cassette 20 may be used is provided below.

The waste disposal device 22 includes a housing 24, a bin 26, a lid 28, and a foot pedal 30. In other embodiments, the waste disposal device 22 has other opening means via a hinge or other linkage, such as a door (not shown), or splits about a cross-sectional region of revealing the inside of the pail (not shown). To facilitate the description herein, the waste disposal device 22 is described herein as having a width that extends along an X-axis, a depth that extends along a Y-axis, and a height that extends along a Z-axis; where X, Y, and Z are orthogonal axes. The housing 24 may also be described as having two side panels 32A, 32B that extend depthwise between a front panel 34 and a rear panel 36. The panels can be connectable or integral, flat, arcuate, etc. . . . . The bin 26 includes a lower end 38, an upper end 40 (disposed heightwise above the lower end 38), and a handle disposed proximate the upper end 40. The bin 26 is configured to pivot a distance about a widthwise-oriented axis disposed proximate the lower end 38, between a closed position (e.g., see FIG. 1) and an open position (e.g., see FIG. 2). The housing 24 and the bin 26 define an inner storage region 41 (shown in FIG. 2, and diagrammatically by hyphenated line in FIG. 1). When the bin 26 is rotated into the open position, the inner storage region 41 is accessible by the user.

Depressing the foot pedal 30 operates a linkage (not shown) that causes the lid 28 to open and provides access to the inner storage region 41 of the waste disposal device 22 via the cassette 20. In some waste-disposal devices 22, depressing the foot pedal 30 also causes a mechanism within the waste-disposal device (e.g., a liner clamping assembly) to move to an "open position" (e.g., an activated state) where it is ready to receive and at least partially contain waste. In some embodiments, the "open position" corresponds to enabling waste to be accepted into the upper portion 33 of the waste disposal device 22. In further embodiments, the "open position" does not impede deposit of waste into a liner disposed within the inner storage region 41. When the foot pedal 30 is released, the lid 28 closes automatically and the mechanism returns to its normally closed position (e.g., an at rest state). In at least one of the open position and closed position, the mechanism clamps (or otherwise closes) the liner (e.g., to mitigate odor emanation).

Some waste disposal devices 22 are configured to permit insertion or removal of a cassette 20 in the portion of the housing 24 disposed below the lid 28 (and typically in close proximity to at least a portion of the lid 28) and/or in the upper portion 33 of the waste disposal device 22. The exemplary embodiment shown in FIGS. 1-3 has such a configuration. Other waste disposal devices 22 may be configured to permit insertion or removal of a cassette 20 from a front surface and/or a side surface of the housing 24. Some waste disposal devices 22 may be configured to permit insertion or removal of a cassette 20 from a direction transverse to the Z-axis of the waste disposal device. Embodiments of the present cassette 20 may be used in any of these configurations, and as indicated above, the present cassette 20 is not limited to use in any particular waste disposal device 22.

Referring to FIGS. 4-11, some embodiments of the present cassette 20 include a liner cavity 42 for containing a supply of liner film 44. The liner cavity 42 may be sized to hold enough liner film 44 for a single use, or alternatively enough liner film 44 for a plurality of uses; e.g., enough liner film to extend from the cassette to near the bottom of the inner storage region 41 a plurality of times. As indicated above, not all embodiments of the present cassette 20 include a liner cavity 42; e.g., some cassette 20 embodiments contain an amount of liner film 44 adequate for a single use (e.g., the cassette 20 and/or length of liner film 44 is filled and disposed-of upon filling the waste disposal device 22 a single time).

For those embodiments that include a liner cavity 42, the liner cavity 42 may assume a variety of configurations adequate to hold the supply of liner film 44. For example, in the embodiment shown in FIGS. 4-6, the liner cavity 42 is defined by an inner wall 50, a bottom wall 52, and an outer wall 54. The inner wall 50 is disposed radially inside of the outer wall 54, and collectively the walls 50 and 54 may be described as being annular (i.e., ring shaped). The bottom wall 52 extends between and connects with the inner wall 50 and the outer wall 54; e.g., at or near bottom surface edges of the inner and outer walls 50, 54. The present disclosure is not limited to a liner cavity 42 formed with three walls; e.g., the liner cavity 42 may have an "open" configuration having one or two walls that are adequate to store a supply of the liner film 44 within the cassette 20; e.g., one or more of the inner wall 50, the bottom wall 52, and the outer wall 54 may be completely removed or be unnecessary to maintain the liner film 44 at least partially within liner cavity 42.

Figure 2:
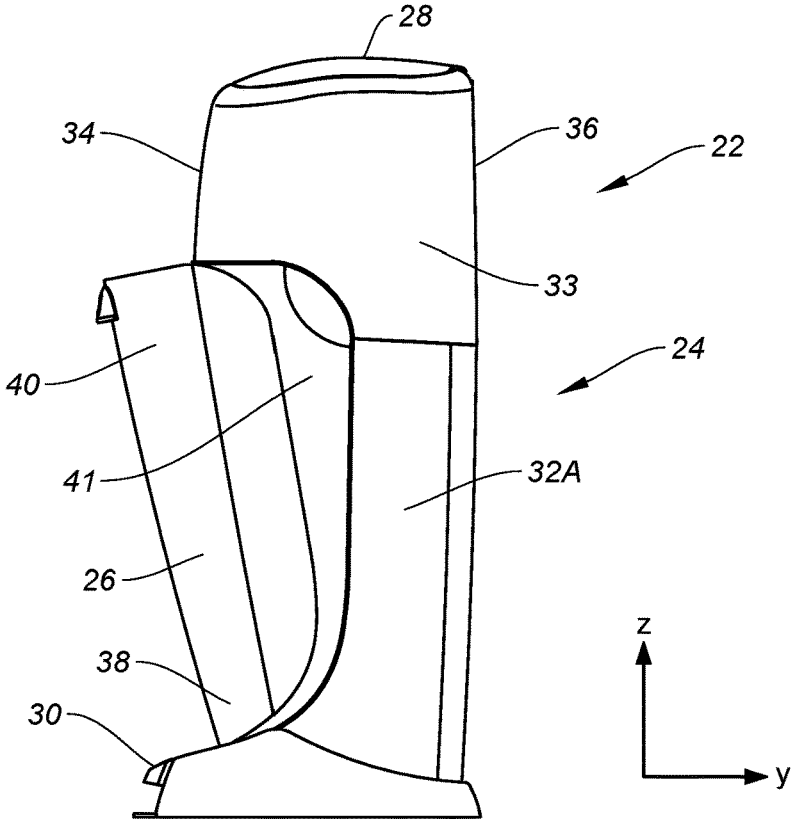
FIG. 2 is a side perspective of a waste disposal device, illustrating a frontal bin rotated to a partially open position.
Figure 3:
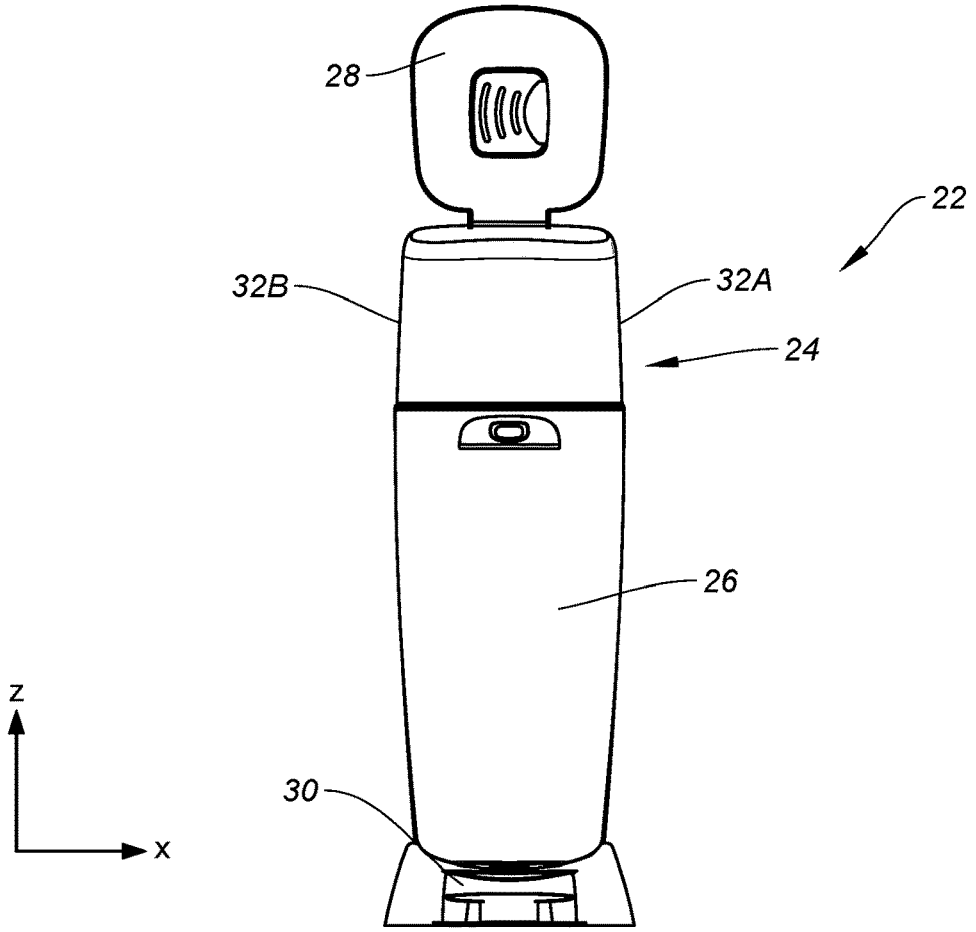
FIG. 3 is a front perspective of a waste disposal device, illustrating a lid rotated to an open position.

The inner wall 50, bottom wall 52, an outer wall 54 define a generally U-shaped cross-section (i.e. a slice taken in the YZ plane or XZ plane, as defined in FIGS. 1-3) having a liner cavity opening 56 that extends between a top surface edge 57 of the inner wall 50 and a top surface edge 55 of the outer wall 54. In some embodiments, the U can be modified to have various tapers and/or include multiple facets or chamfers to assist with how the cassette 20 is oriented into the waste disposal device 22, how the cassette 20 interacts with the waste disposal device 22 and cooperates with various other structures such as film clamping structures with portions or components requiring a range of motion.

The top surface edge 57 of the inner wall 50 may be higher, lower, or at the same height as the top surface edge 55 of the outer wall 54. An inner wall 50 with a top surface edge 57 that is higher than the top surface edge 55 of the outer wall 54 can be particularly useful when liner is dispensed from the liner cavity 42 outwardly from the top surface of the cassette proximal to and/or adjacent the inner wall 50; e.g., the higher top surface edge 57 of the inner wall 50 can assist in metering film 44 stored within the liner cavity 42 by acting as a fulcrum and thereby increasing tension on the film 44 as waste is added to the waste disposal device 22. Also, an inner wall 50 with a higher top surface edge 57 can enable the inner wall 50 to act as an alignment feature when vertically stacking one or more cassettes (e.g., cassettes may be stacked and sold as multi-packs), and/or can be configured to mate with the lid 26 to provide a quasi-sealing function that helps prevent undesirable odor escaping from the waste disposal device 22. Likewise, an outer wall 54 having a higher top surface edge 55 can also provide an alignment feature when vertically stacking one or more cassettes, and/or can be configured to mate with lid 28 to provide a quasi-sealing function.

Figure 9:
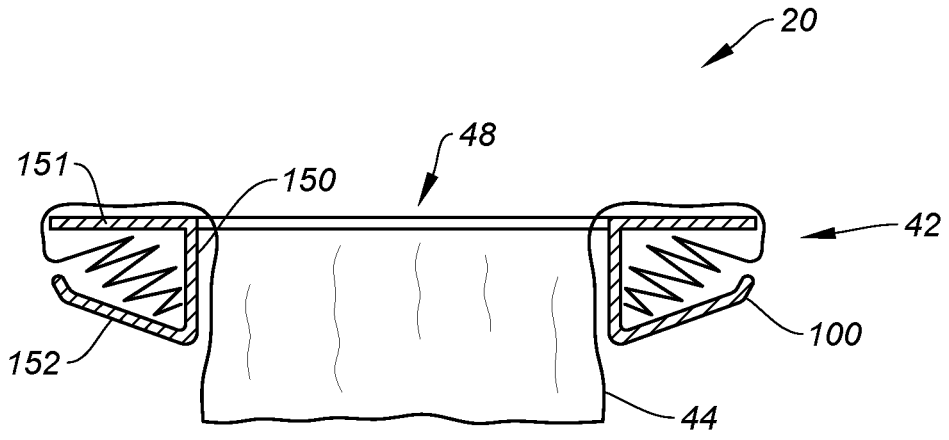
FIG. 9 is a diagrammatic sectional view of a cassette embodiment.
Figure 10:
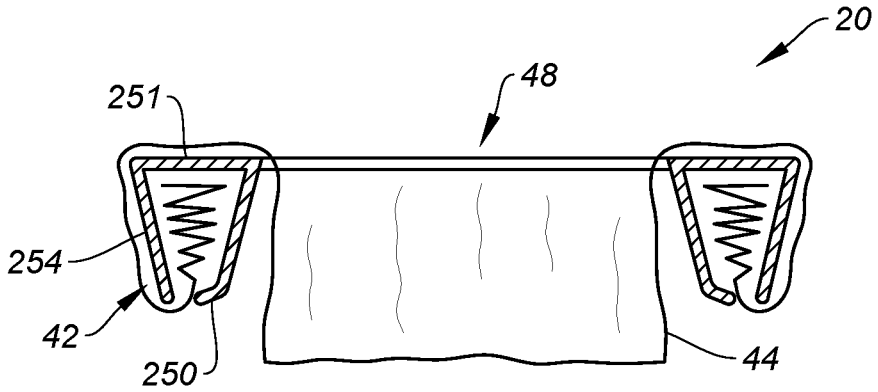
FIG. 10 is a diagrammatic sectional view of a cassette embodiment.
Figure 11:
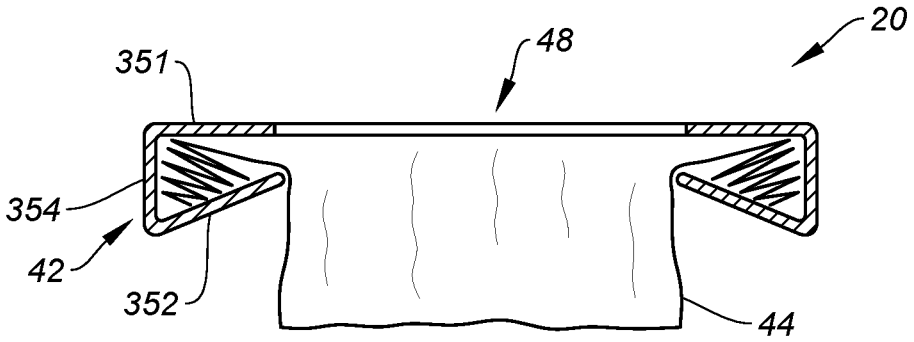
FIG. 11 is a diagrammatic sectional view of a cassette embodiment.

The above described liner cavity 42 configuration is provided to illustrate an example of a liner cavity 42 (i.e., one wherein liner film exits from a top position), and the present disclosure is not limited thereto. Other liner cavity 42 configuration examples include those that allow liner film 44 to exit the liner cavity 42 laterally or from a bottom position. For example, FIG. 9 diagrammatically depicts a liner cavity 42 defined by a top wall 151, a bottom wall 152, and an inner wall 150 that extends between the top and bottom walls 151, 152. In this liner cavity 42 configuration, the liner film 44 exits laterally outward and is drawn back over the top wall 151 of the liner cavity 42 and subsequently down through the central passage 48. FIG. 10 diagrammatically depicts another liner cavity 42 configuration defined by an inner wall 250, an outer wall 254, and a top wall 251 that extends between the inner and outer walls 250, 254. In this liner cavity 42 configuration, the liner film 44 exits the bottom of the liner cavity 42, and may be drawn around the outer wall 254, back over the top wall 251 of the liner cavity 42 and subsequently down through the central passage 48. Alternatively, the liner film 44 may exit the bottom of the liner cavity 42, and be drawn into the waste disposal device 22 below the central passage 48. In such configurations, the cassette 20 might mate with and/or be situated in the waste disposal device 22 about a surface contacting and supporting either inner wall 250, outer wall 254, and/or the bottom. FIG. 11 diagrammatically depicts a liner cavity 42 defined by a top wall 351, a bottom wall 352, and an outer wall 354 extending there between. In this liner cavity 42 configuration, the liner film 44 exits laterally inwardly and is drawn down through the central passage 48. In these embodiments, a partial wall or edge 100 may exist to adjust how the liner film is dispensed, and/or maximize storage volume in the liner cavity. In some embodiments a partial wall or edge 100 extends from each wall to adjust the liner film 44 as it exits liner cavity 42 through opening 90.

The aforementioned embodiments having film that dispenses from the outer edge 55 of the top wall 150, the outer wall 54 and/or the bottom wall 52 (and/or inner wall 50 if the film is looped over and around the body of the cassette 20) in that the top surface is covered by liner film and thus mitigates against inadvertently soiling portions of the cassette other than the liner film and/or enabling the consumer to insert diapers with less precision without soiling portions of the cassette other than the liner film.

Embodiments where the film 44 is dispensed through an opening 90 on the inner wall 150 (or in lieu of the inner wall 150) require the shortest length of liner film 44 be dispensed in order to prepare the cassette 20 and waste disposal device 22 for use. This assists in reducing the amount of time required to prepare the cassette 20 for use. Further, this assists in reducing the length of soiled film that needs to be changed when the liner film 44 becomes full, thereby reducing the amount of film 44 required for storing waste.

Any of the aforementioned walls 151, 152, 250, 254, 351, 352 can have surface edges of varying heights relative to other walls to define a fulcrum for controlling dispensation of film 44 and/or defining alignment features for stacking multiple cassettes. In some embodiments, walls and/or upper surface edges of walls can create a frusto-conical, chamfered, roundels, or steeple shapes that assist in funneling film 44 towards the opening 90 and/or in embodiments a liner cavity 42, metering film 44 exiting the liner cavity 42. Such shapes can help mitigate against the film 44 end not being proximal to the opening 90 and thus avoid difficulties initially finding the film 44 and removing it from the liner cavity 42 for use. Furthermore, having a narrowed opening 90 configuration can reduce the necessity for an additional film 44 containment mechanism such as a top panel 89 that is partially removable via a removal portion 85 (i.e. tear strip, label, sticker, shrink-wrap, etc. . . . ). In other embodiments, removal portion 85 can initially block opening 90, but upon removing removal portion 85, opening 90 is revealed to permit liner film 44 to be withdrawn from liner cavity 42.

In its various different embodiments, the cross-sectional geometry (i.e. a slice taken in the YZ plane or XZ plane, as defined in FIGS. 1-4) of the liner cavity 42 may be consistent around the entire perimeter of the cassette 20 or it may vary in cross-sectional geometry around the perimeter of the cassette 20; e.g., the height, width, and generally the geometry of the liner cavity 42 may vary around the perimeter. In those embodiments wherein the cross-sectional geometry of the liner cavity 42 varies, the cross-sectional area of the liner cavity 42 may be consistent around the perimeter of the cassette 20.

The liner cavity walls may assume a variety of different configurations relative to one another, and relative to the cassette 20 overall. The liner cavity 42 embodiment shown in FIG. 4, for example, has inner and outer walls 50, 54, respectively, that are generally parallel (e.g., with or without draft), and a bottom wall 52 that extends generally perpendicular to the inner and outer walls 50, 54. The liner cavity 42 embodiments shown in FIGS. 9-11, in contrast, illustrate non-parallel walls (e.g., walls are angled with more than draft). In other embodiments, the liner cavity walls may be relatively oriented to create to create convex and/or concave surfaces. Such surfaces can make it easier for a user to correctly identify how a cassette 20 should be inserted within a waste disposal device 22 (e.g., surfaces that mate with structure within the waste disposal device 22 to ensure proper orientation of the cassette 20), and/or facilitate interaction with one or more waste disposal device components to improve functionality of the waste disposal device 22, and/or facilitate nested stacking of the cassette 20 during storage. Furthermore, cassette 20 as described herein has a geometry about its outer wall 54 and/or inner wall 50 providing asymmetry with regard to at least one axis and/or plane such that a user can more easily identify the proper way to orient cassette 20 within a waste disposal device 22 having a suitably shaped receiving geometry and/or mating features.

Figure 4:
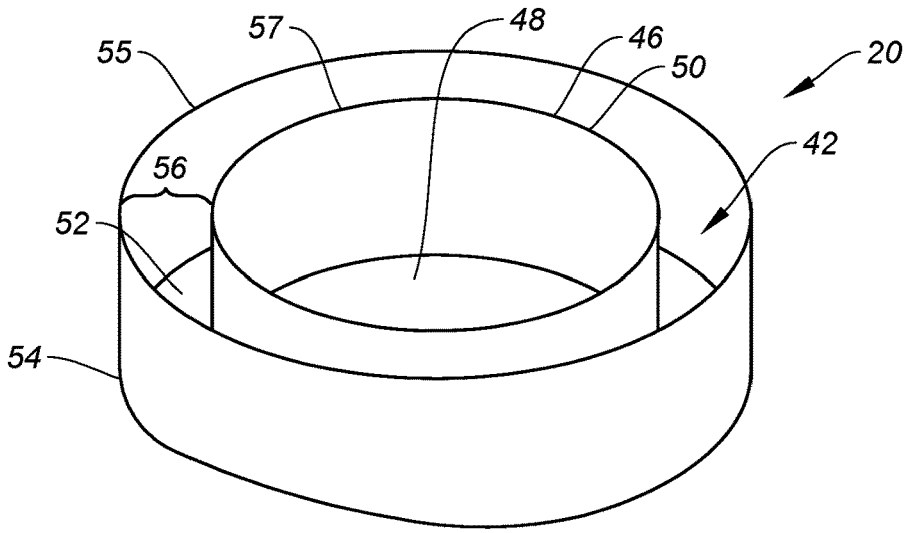
FIG. 4 is a diagrammatic perspective view of a cassette embodiment without liner film.
Figure 5:
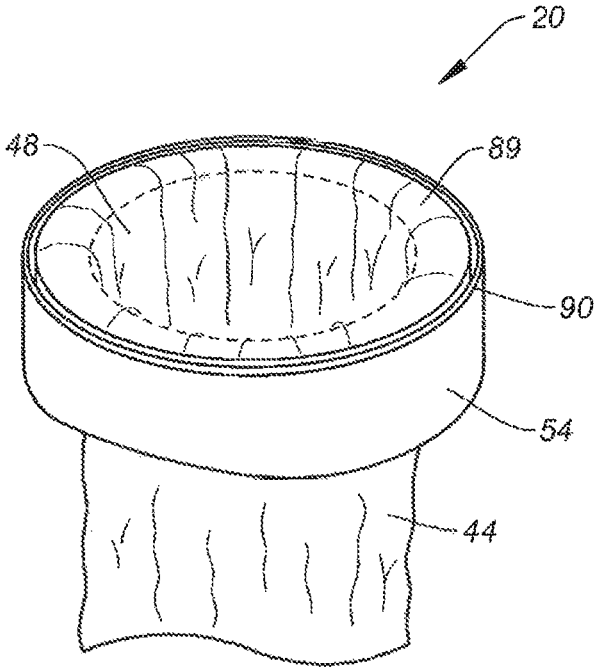
FIG. 5 is a diagrammatic perspective view of a cassette with a segment of liner film drawn out of a liner cavity and through a central passage of the cassette.
Figure 6:
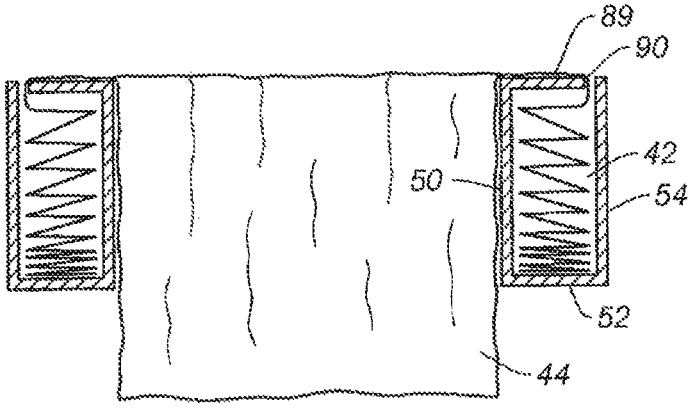
FIG. 6 is a cross-sectional diagrammatic view of a cassette with a segment of liner film drawn out of a liner cavity and through a central passage of the cassette.

In the embodiment shown in FIGS. 4-6, the inner wall 50 defines the geometry of the central passage 48. In alternative embodiments, the cassette 20 may include a structure inside the periphery of the inner wall 50 that defines the geometry of the central passage 48. Likewise, alternative embodiments may include a structure outward of the periphery of the outer wall 54 to define the geometry of the cassette 20 body to assist how the cassette 20 engages the waste disposal device. These geometry setting features can provide visual cues to the consumer to help assist with loading of the cassette 20 and/or depositing waste.

Figure 7:
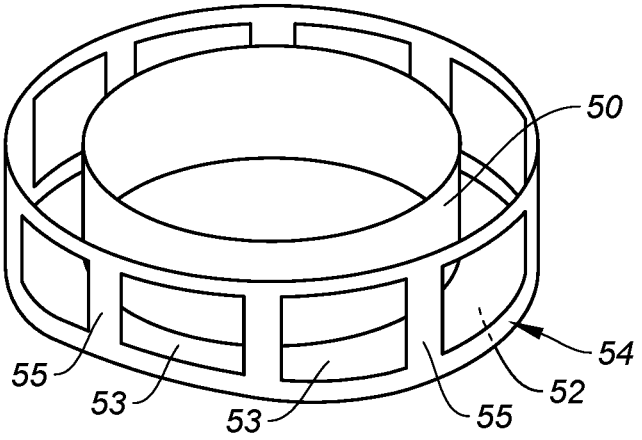
FIG. 7 is a diagrammatic perspective view of a cassette embodiment without liner film.

For those cassette 20 embodiments that include a liner cavity 42, the walls that form the liner cavity 42 may assume any configuration adequate to hold the supply of liner film 44. For example, one or more of the walls may have a continuous solid wall configuration. FIG. 4 illustrates a liner cavity 42 formed from solid continuous walls. Alternatively, one or more of the liner cavity 42 walls may have a discontinuous wall configuration, e.g. a wall with one or more apertures extending there through. FIG. 7 illustrates an embodiment wherein each of the inner wall 50 and the bottom wall 52 are a continuous wall structure and the outer wall 54 has a discontinuous wall structure wherein apertures 53 are disposed between ribs 55. A discontinuous wall structure may be used to decrease the amount of material required to create the liner cavity 42, and thereby reduce the weight of the cassette 20. In some embodiments, one or more apertures 53 and/or one or more ribs 55 act as mating features to reciprocal features positioned and suitably sized accordingly in the waste disposal device 22. In some embodiments, one or more apertures 53 cover more than 10% of the surface area of the cassette 20 body. In some embodiments, one or more apertures 53 cover more than 25% of the surface area of the cassette 20 body. The exemplary embodiments shown in FIGS. 4-7 are provided to illustrate the present disclosure and the present disclosure is not limited thereto.

The liner cavity 42 may, in general, be formed as a one-piece structure (e.g., the inner and outer walls 50, 54 and bottom wall 52 formed as a one-piece structure by injection molding, blow molding, thermoforming, etc. . . . ). Alternatively, the liner cavity 42 may be formed from a plurality of independent pieces that are attached to one another to create the liner cavity collectively. Such assembly can be accomplished by adhesives, bonding agents, welding, ultrasonics, fasteners or mechanical means such as male and female members, detents, press fit, flexible latch members that can be displaced during assembly, combinations thereof, etc. . . . .

Figure 12:
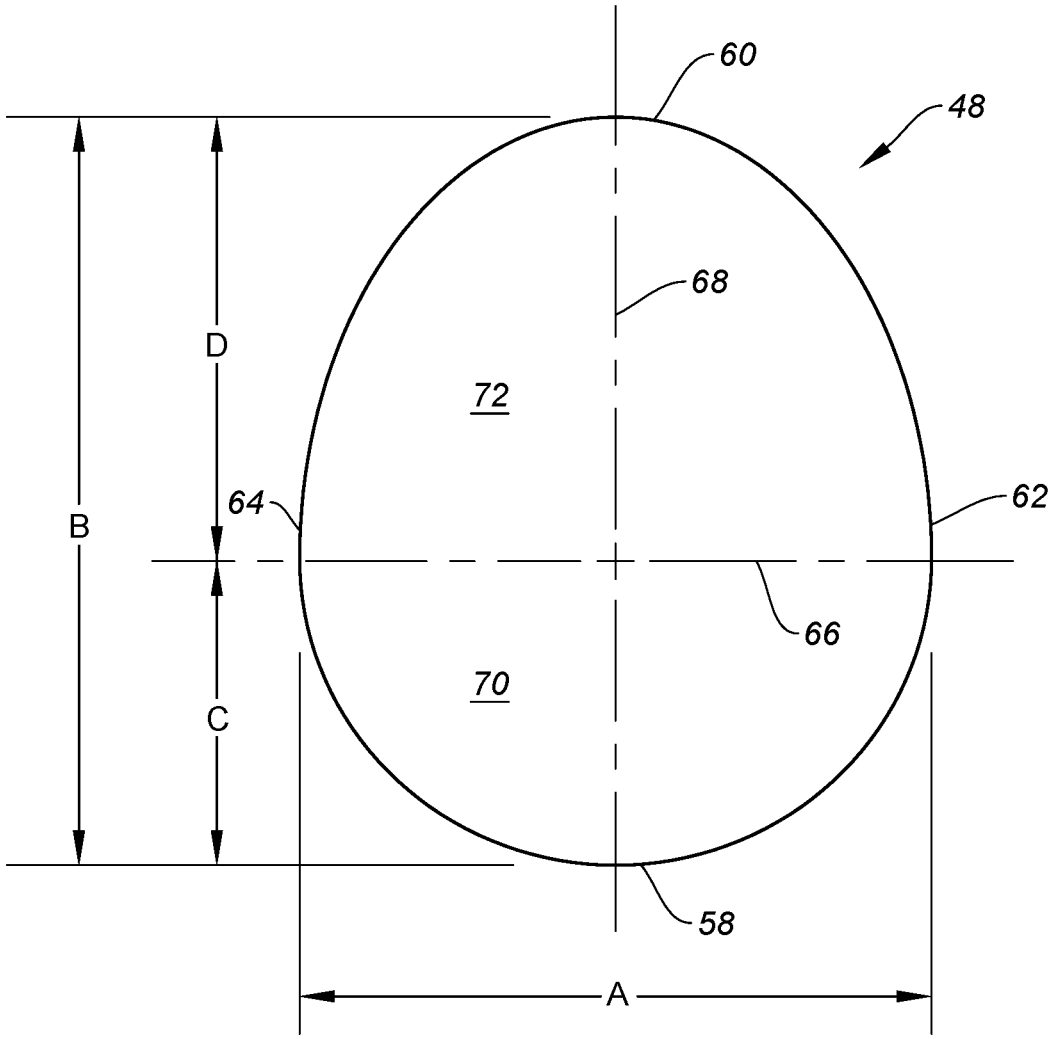
FIG. 12 is a diagrammatic illustration of a cassette central passage geometry embodiment.

Now referring to FIG. 12, in all of the embodiments of the present cassette 20 (e.g., those where the film 44 is at least partially stored within the cassette 20 and those that do not include a liner cavity 42), the central passage 48 has a forward edge 58, an aft edge 60, a first side edge 62, a second side edge 64, a widthwise axis 66, and a depthwise axis 68. The widthwise axis 66 and the depthwise axis 68 are perpendicular to one another. The widthwise axis 66 extends a distance "A" between the first and second side edges 62, 64. The depthwise axis 68 extends a distance "B" between the forward edge 58 and the aft edge 60, and the distance B is greater than the distance A. The widthwise axis 66 is disposed at the maximum widthwise dimension of the central passage 48. The depthwise axis 68 is disposed at the maximum depthwise dimension of the central passage 48. The portion of the depthwise axis 68 that extends between the widthwise axis 66 and the forward edge 58 has a distance "C"; i.e., the widthwise axis 66 is separated from the forward edge 58, and the distance C represents the maximum separation distance between the widthwise axis 66 and the forward edge 58. The portion of the depthwise axis 68 that extends between the widthwise axis 66 and the aft edge 60 has a distance "D"; i.e., the widthwise axis 66 is separated from the aft edge 60, and the distance D represents the maximum separation distance between the widthwise axis 66 and the aft edge 60. The distance D is greater than the distance C. The central passage 48 may be described as comprising a front portion 70 and a rear portion 72, with the front portion 70 disposed forward of the widthwise axis 66 and the rear portion 72 disposed aft of the widthwise axis 66. The widthwise distance between the first and second edges 62, 64 decreases in the direction toward the aft edge 60, or decreases in the direction toward the forward edge 58, or both; i.e., the entirety of each side edge 62, 64 is not parallel to the other.

The geometry of the central passage 48 of the cassette greatly influences the ease with which a user can introduce a waste product into the waste disposal device 22. The central passage geometry described above represents a geometry that facilitates the passage of waste into the waste disposal device 22, and an improvement over the prior art of which we are aware. Within the constraints described above, the present central passage 48 may assume a variety of specific configurations. To illustrate such configurations, non-limiting examples are provided below.

Figure 13:
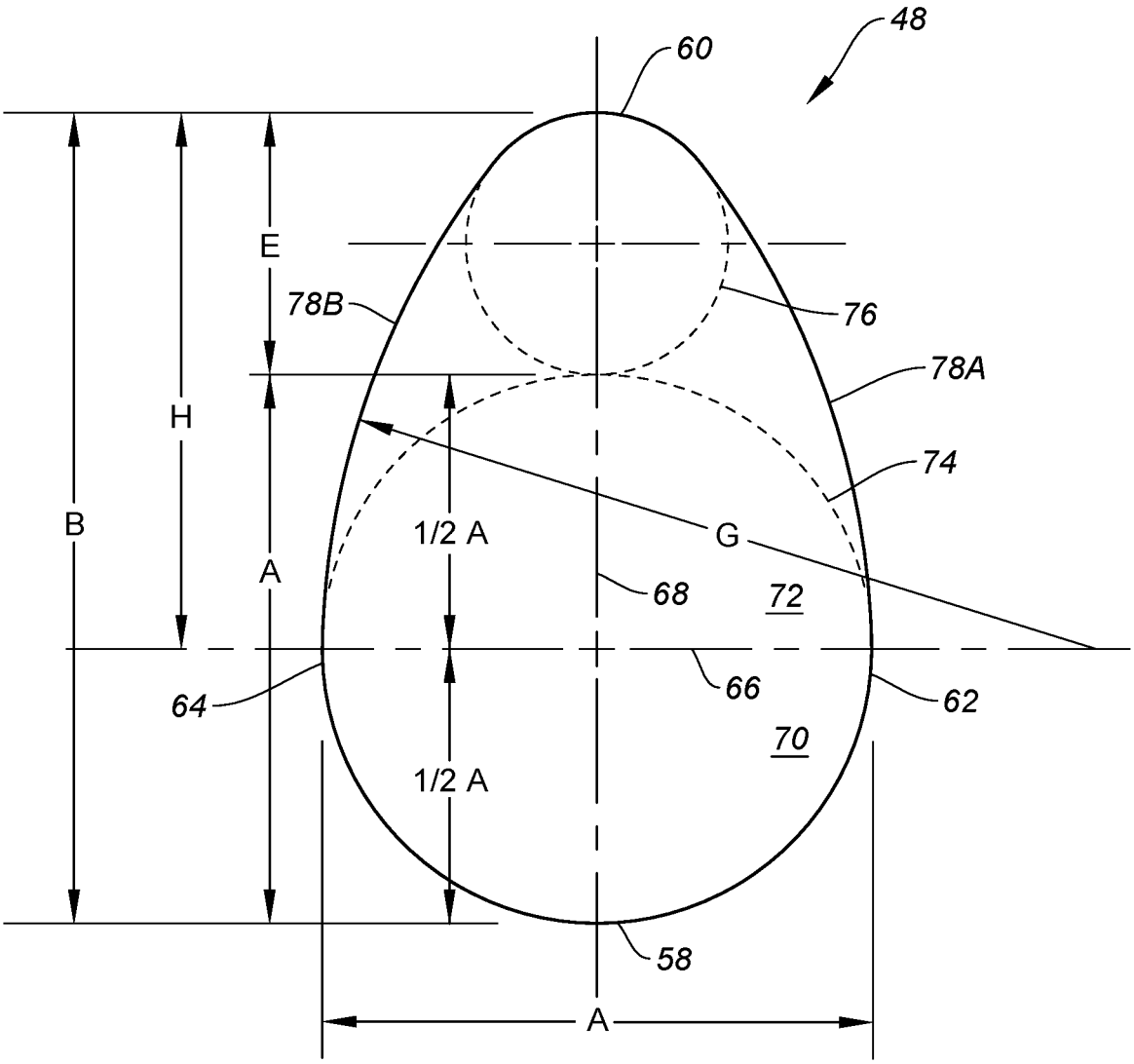
FIG. 13 is a diagrammatic illustration of a cassette central passage geometry embodiment.

Now referring to FIG. 13, in a first embodiment, the geometry of the central passage 48 may be described as an ovoid defined by a major circle 74 and a minor circle 76. The major circle 74 has a diameter equal to the widthwise axis length "A" extending between the first and second side edges 62, 64. The minor circle 76 has a diameter equal to a distance "E". The distance B of the depthwise axis 68 in this embodiment equals the sum of the diameters of the major and minor circles 74, 76 (i.e., A+E=B). This represents a specific non-limiting embodiment where the distance between the center of circles 74 and 76 equals the sum of the radii of the respective circles, but in the general case, the distance between the center of circles 74 and 76 may be greater or less than the sum of the radii. Arcuate segments 78A, 78B tangentially intersect the perimeter of the major circle 74 and the perimeter of the minor circle 76 on each side of the central passage 48 (e.g., an arc having a radius "G" disposed on both sides of the cavity) to complete the perimeter of the ovoid-shaped central passage 48. The portion of the depthwise axis 68 that extends between the widthwise axis 66 and the forward edge 58 has a distance one-half A (½ A); i.e., the widthwise axis 66 is separated from the forward edge 58, and the distance ½ A represents the maximum separation distance between the widthwise axis 66 and the forward edge 58. The portion of the depthwise axis 68 that extends between the widthwise axis 66 and the aft edge 60 has a distance "H" equal to the sum of ½ A and E (½ A+E=H); i.e., the widthwise axis 66 is separated from the aft edge 60, and the distance H represents the maximum separation distance between the widthwise axis 66 and the aft edge 60. The distance H is greater than the distance ½ A. In this particular central passage 48 embodiment, the distance ½ A is also the distance along the widthwise axis 66 between first side edge 62 and the depthwise axis 68, and the distance along the widthwise axis 66 between second side edge 64 and the depthwise axis 68. Also as indicated above, the central passage 48 may be described as comprising a front portion 70 and a rear portion 72, with the front portion 70 disposed forward of the widthwise axis 66 and the rear portion 72 disposed aft of the widthwise axis 66.

As stated above, the present central passage 48 may assume a variety of specific configurations within the central passage 48 geometry constraints described above, and the specific geometry shown and described relative to FIG. 13 is a non-limiting example of a central passage 48 geometry.

Variations of the present ovoid central passage 48 geometry shown in FIG. 13 include, for example, an ovoid wherein the major and minor circles are separated from one another (thereby increasing the maximum depthwise dimension), or an ovoid wherein the major and minor circles overlap one another (thereby decreasing the maximum depthwise dimension), or ovoids that are defined by multiple different radii, or ovoids defined by arcuate lines, splines, etc.

Figure 14:
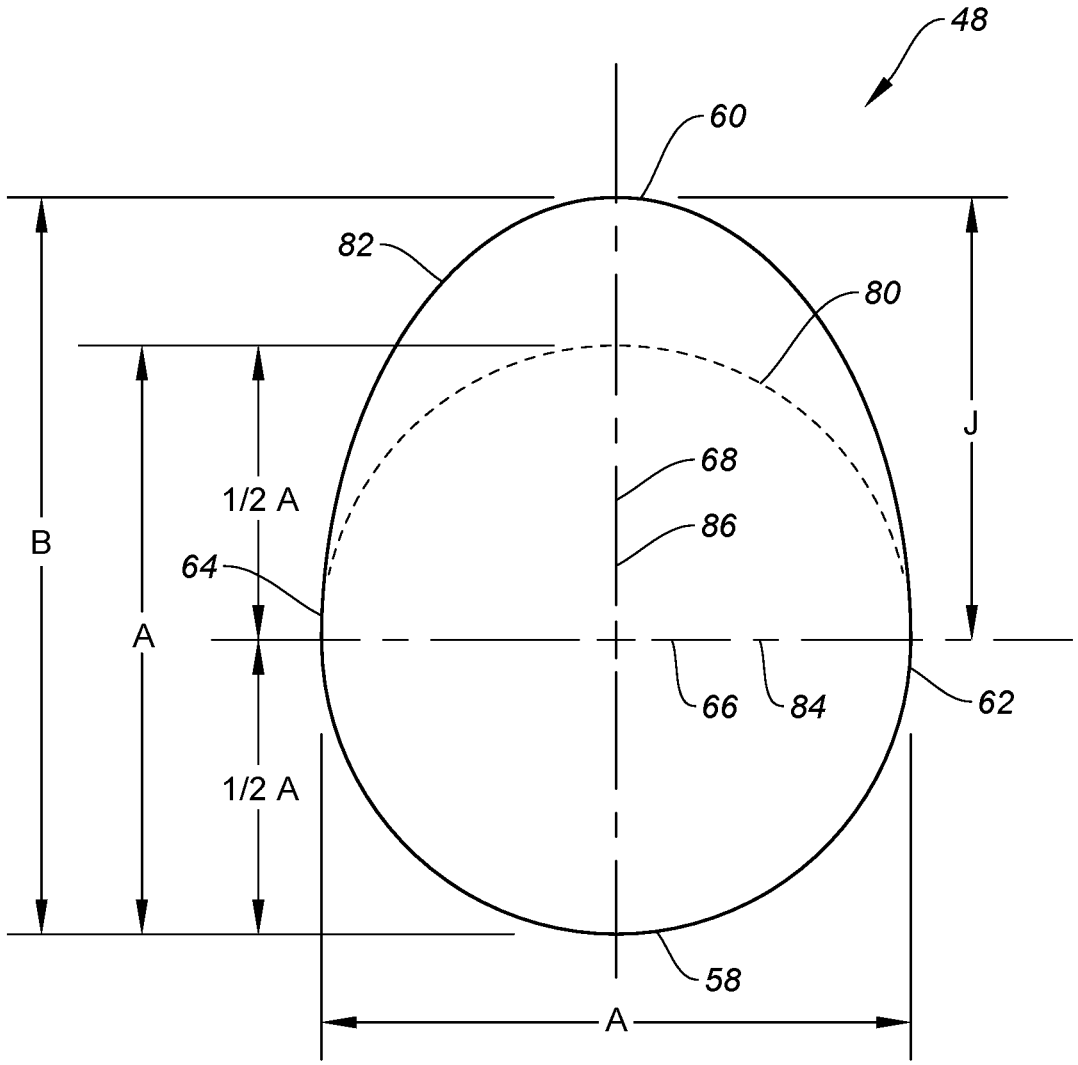
FIG. 14 is a diagrammatic illustration of a cassette central passage geometry embodiment.

Now referring to FIG. 14, in a second embodiment the geometry of the central passage 48 may be described as an ovoid defined by a circle 80 and an oval 82, and/or truncated portions of a circle 80 and/or an oval 82. For purposes of describing this particular embodiment, an "oval" is defined to be any egg-shaped curvature that has symmetry about at least one axis. The term "oval" as used herein also includes geometries that are symmetric about two axes, such as elliptical shapes, oblate and prolate in part and/or in combination. The circle 80 has a diameter equal to the widthwise axis length "A" extending between the first and second side edges 62, 64. The oval 82 has a minor diameter 84 and a major diameter 86 (respectively coincident with the widthwise axis 66 and the depthwise axis 68). The minor diameter 84 is equal to the diameter of the circle 80. One-half of the major diameter 86 of the oval (identified as the distance "J") is greater than the radius of the circle (i.e., A/2). The distance B of the depthwise axis 68 in this embodiment equals the sum of the one-half the circle diameter (i.e. A/2) plus the distance J (i.e., ½ A+J=B). The portion of the depthwise axis 68 that extends between the widthwise axis 66 and the forward edge 58 has a distance one-half A (½ A); i.e., the widthwise axis 66 is separated from the forward edge 58, and the distance ½ A represents the maximum separation distance between the widthwise axis 66 and the forward edge 58. The portion of the depthwise axis 68 that extends between the widthwise axis 66 and the aft edge 60 is equal to the distance "J"; i.e., the widthwise axis 66 is separated from the aft edge 60, and the distance J represents the maximum separation distance between the widthwise axis 66 and the aft edge 60. The distance J is, in some embodiments, half the major diameter 86 of oval 82. The distance J is greater than the distance ½ A. Also as indicated above, the central passage 48 may be described as comprising a front portion 70 and an aft portion 72, with the front portion 70 disposed forward of the widthwise axis 66 and the aft portion 72 disposed aft of the widthwise axis 66.

As indicated above, the above embodiments represent non-limiting examples of a central passage geometry according to the present disclosure. The provided central passage 48 examples are symmetrical about a mid-point defining a plane with respect to depthwise axis 68, and exhibit a lack of reflective symmetry with respect to other axes, i.e. there is only one axis of symmetry. In one embodiment, the cassette has symmetry about the depthwise axis. In another embodiment, the cassette has symmetry about the widthwise axis. The present cassette 20 is not limited to having a central passage 48 with a symmetrical geometry.

In other embodiments, the ovoid geometry can be a combination of one or more spline segments yielding a generally ovoid shape. For example, one or more splines may be configured to create a generally arcuate shape defining the forward edge 58 of the cassette 20. One or more splines may be configured to create a generally arcuate shape defining the aft edge 60 of the cassette 20. For instance, four splines may be connected such that a first spline 400 and a second spline 402 are generally the same geometry, and a third spline 404 and fourth spline 406 are generally the same geometry but are different from the geometry of the first and second splines. This exemplary combination of splines provide symmetry with respect to the depthwise axis. In certain embodiments, the cassette 20 may be shaped (due the configuration of the splines defining the forward edge 58) such that the greatest widthwise dimension 410 in cassette 20 is between the forward edge 58 of the cassette 20 and the midpoint 408 of the cassette 20 length. In other embodiments, there may be more than four splines to further augment geometry, such as six eight ten, etc. . . . . In alternative embodiments, there are an odd number of splines such that one spline does not correspond with another spline. In some embodiments, one ore splines provide a maximum widthwise dimension 410 between the forward edge 58 and the midpoint of the maximum lengthwise dimension 412.

In some embodiments, the maximum widthwise dimension of the central passage 44 is greater than the maximum widthwise dimension 410 of a non-ovoid shape such as a simple circle. In further embodiments, the maximum widthwise dimension 410 of the central passage 44 is about 10% greater than the maximum widthwise dimension of a non-ovoid shape such as a simple circle. In yet further embodiments, the maximum widthwise dimension 410 of the central passage 44 is more than 10% greater than the maximum widthwise dimension of a non-ovoid shape such as a simple circle. In other embodiments, the maximum depthwise dimension 412 of the central passage is greater than the maximum depthwise dimension of a non-ovoid shape such as a simple circle. In other embodiments, the maximum depthwise dimension 412 of the central passage is about 10% greater than, or is more than 10% greater than, the maximum depthwise dimension of a non-ovoid shape such as a simple circle. In further embodiments, the maximum depthwise dimension exceeds the maximum widthwise dimension by at least 5%, at least 10%, and/or at least 20%. In some embodiments, a maximum depthwise dimension 412 is aligned with the depthwise-axis of cassette 20. In some embodiments, a maximum depthwise dimension 412 is (a) aligned with the center axis of waste disposal device 22, and/or (b) is the perpendicular bisector of the front edge of the waste disposal device 22. In some embodiments, the maximum widthwise dimension 410 is proximal the front edge of waste disposal device 22 such that it is (a) frontward of the widthwise center axis of waste disposal device 22 and/or (b) is parallel to the front edge of waste disposal device 22.

In further embodiments, splines are utilized to maximize the area of the central passage to reduce difficulty with inserting messy, large and/or odd-shaped waste such as diapers or waste disposing accoutrements such as scoops.

The liner film 44 is a film formed in a closed perimeter configuration that extends a length. The closed perimeter configuration is such that the liner material has a continuous perimeter that extends lengthwise; e.g., the configuration may be described as "tubular". The cross-sectional configuration of the liner film 44 (i.e., the cross-sectional perimeter shape in the XY plane) may vary depending on the particular configuration. The liner film 44 is comprised of a material that is flexible, capable of being stored within the liner cavity 42, capable of being readily drawn out of the liner cavity 42, and capable of being formed in a closed configuration (e.g., tied-off) as will be described below. A flexible plastic film (e.g., a thermally stable polymer film or a polymer film that shrinks when a thermal source is applied) is an example of an acceptable liner film 44. The liner film 44 can include one or more layers of polyethylene, polypropylene, polyester, EVA, EVOH, nylon, tie resin, and may further include additives such as calcium carbonate, talc, titanium dioxide, and slip agents. Embodiments of the liner film 60 may include agents that mask odor such as fragrance, mitigate odors including carbon, zeolite, silica and other odor adsorbers and odor absorbers, etc.

Figure 8:
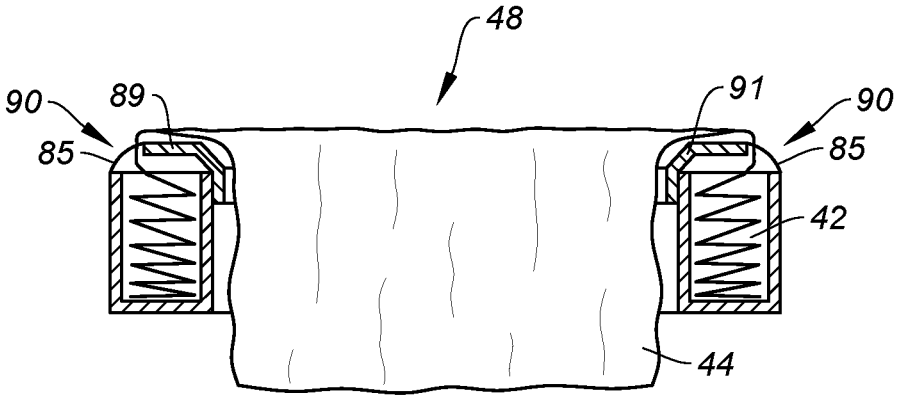
FIG. 8 is a cross-sectional diagrammatic view of a cassette with a segment of liner film drawn out of a liner cavity and through a central passage of the cassette.

Now referring to FIGS. 5, 6, and 8, as indicated above, the liner cavity 42 defines a shaped cavity sized to hold the supply of liner film 44. The liner film 44 is stored within the liner cavity 42 in an orientation that allows the liner film 44 to be drawn out of the liner cavity 42. In the embodiments shown in FIGS. 5, 6, and 8, the cassette 20 is configured such that the liner film 44 may be drawn out of the liner cavity 42 through an opening 90 disposed at the liner cavity opening 56; e.g., the cassette 20 diagrammatically shown in FIGS. 5 and 6 includes a top panel 89 that substantially covers the liner cavity opening 56, creating the opening 90 through which the liner film 44 is drawn out of the liner cavity 42. FIG. 8 includes a top panel 89 that substantially covers the liner cavity opening 56, creating the opening 90 through which the liner film 44 is drawn out of the liner cavity 42. The top panel 89 also includes a chamfer surface 91 that facilitates waste disposal into the central passage 48. As indicated above, the present cassette 20 is not limited to any particular liner film path configuration. The present cassette 20 is also not limited to any particular manner for arranging the liner film 44 within the liner cavity 42 (e.g., folded, pleated, etc.), provided the liner film 44 can be readily drawn out from the liner cavity 42 on demand by the user.

The present cassette 20 can be removed and replaced from the waste disposal device 22 as needed. For example, in the waste disposal device embodiment shown in FIGS. 1-3, the cassette 20 can be replaced by opening the waste disposal device 22 via, for instance, lid 28, removing the empty cassette 20 from the housing 24 (if necessary), and placing an unused cassette into the housing 24. The user orients the cassette 20 in the waste disposal device 22 such that front edge 58 engages the front end of the waste disposal device 22. In those cassette 20 embodiments that include a liner cavity 42, the user then withdraws a length of the liner film 44 from the liner cavity 42, feeds it through the central passage 48, and into the inner storage region 41, so that the free end of the liner film 44 is disposed near the lower end of the bin 26. The user then closes off the free end of the liner film 44 to form a liner film "bag" (e.g., by tying the liner film 44 into a knot adjacent the free end) and closes the bin 26; the user can optionally close the liner film 44 to form a "bag" prior to feeding it through the central passage 48. In this configuration, the waste disposal device 22 (and specifically the liner film 44) is ready to receive waste such as, but not limited to, disposable diapers, nappies, training pants, feminine hygiene products, incontinence products, and pet waste such as litter and/or disposable pet waste pads and/or wipes. Gravitational forces urge the waste deposited into the liner film bag toward the closed-off free end of the liner film bag. When the liner film bag is full of waste, the upper end of the liner film 44 is separated from the supply of liner film 44 (e.g. by cutting the liner film 44 at a point above the stored waste), and the bag is removed from the waste disposal device 22. The just-separated end of the liner film 44 may then be closed (e.g., by knot or fastener) and the bag disposed of. The process is then repeated; e.g., the user withdraws another length of the liner film 44 from the liner cavity 42, drawing it through the cassette 20 central passage 48 and into the bin 26. The user (before or after) closes off the free end of the liner material to form a new liner film bag.

Figure 16A:
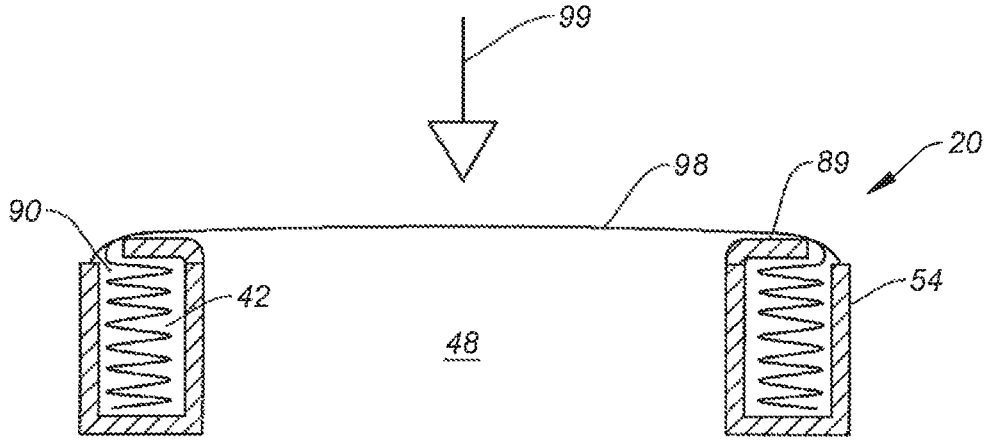
FIG. 16A is a cross-sectional diagrammatic illustration of a cassette embodiment having a film seal.
Figure 16B:
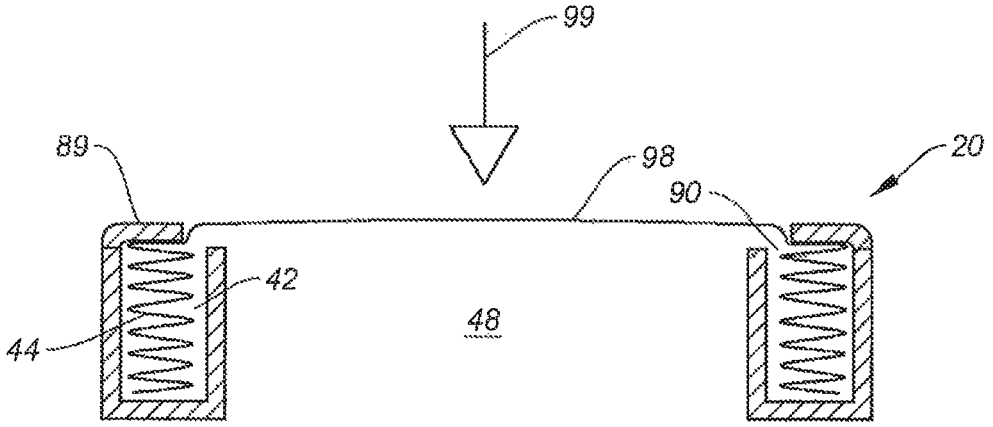
FIG. 16B is a cross-sectional diagrammatic illustration of a cassette embodiment having a film seal.

As shown in FIGS. 16*a*-16B, the cassette 20 has a film seal 98. Film seal 98 attaches at least partially to a free end of liner film 44 that is positioned proximal the opening 90. In some embodiments as in FIG. 16A, film seal 98 at least partially attaches to the top panel 89, and/or outer wall 54 of the cassette, or any other edge, wall or panel that defines opening 90. In some embodiments, the film seal 98 can attach to the top of the cassette and/or the bottom of the cassette, or at various points along the central passage. Film seal can attach at a point, multiple points, or to entire surfaces of a wall, edge, and/or the liner film 44. Film seal 98 is advantageous in that it avoids the need to knot the liner film 44 when the cassette 20 is first used. In some embodiments, film seal 98 is further advantageous in that it enables the user to simply push downward represented by arrow 99 on the top of the cassette over central passage 48 to use the cassette as opposed to having to (a) restrain the cassette 20 to (b) pull liner film 44 through opening 90 from the liner cavity 42, (c) form a closed-end of the bag by, i.e., tying a knot in the film 44 and (d) thread the film through the waste disposal device 22. The film seal 98 accomplishes all four of these steps in a simple push as demonstrated by arrow 99.

The film seal 98 attaches to the liner film 44 to ensure such weights can be supported without failure of the bag. The film seal 98 can be achieved by heat, glue, ultrasonics, and other known means of adhering, melting, bonding or otherwise attaching film materials to each other. In some embodiments, the film seal 98 is made from a paper, pulp, resin, foil, adhesive or bonding materials, or combinations thereof.

In some embodiments, prior to use and during use, the film 44 is at least partially contained within the film cavity 42 until the film 44 is exhausted. In other embodiments, the film 44, prior to and during use, is at least partially located within the central passage 48. In these embodiments, prior to use, a length of film 44 less than or about equal to the length of the waste disposal device 22, is nested within the central passage 48. The user, either directly (manually with a push) or indirectly (i.e. mechanically via the waste disposal device 22), breaks the film seal 98 enabling the length of film 44 in the central passage 48 to extend downward into the inner storage region 41 of the waste disposal device 22. In these embodiments, the cassette 20 can optionally hold a greater length of film 44 as both the film cavity 42 and the central passage 48 permit storage of film 44. For instance, if a typical cassette 20 holds enough film 44 collect to between about two-hundred and forty (240) and about two-hundred and eighty (280) infant diapers, and a typical waste disposal device 22 holds about thirty-five (35) to one hundred (100) newborn diapers before requiring emptying (i.e. the cassette provides enough film to accommodate between about three (3) and about seven (7) full pails of diapers), then the cassette 20 of this embodiment holds approximately two hundred and seventy five to about three-hundred and eighty-five (385) newborn diapers or at least about ten percent (10%) more capacity without otherwise modifying the cassette 20. In other embodiments, at least about fifteen percent (15%) more capacity is provided. In further embodiments, at least about twenty-five percent (25%) more capacity is provided. Thus, the waste disposal device 22 reaches capacity one additional time prior to the cassette 20 being exhausted and requiring replacement.

Figure 15:
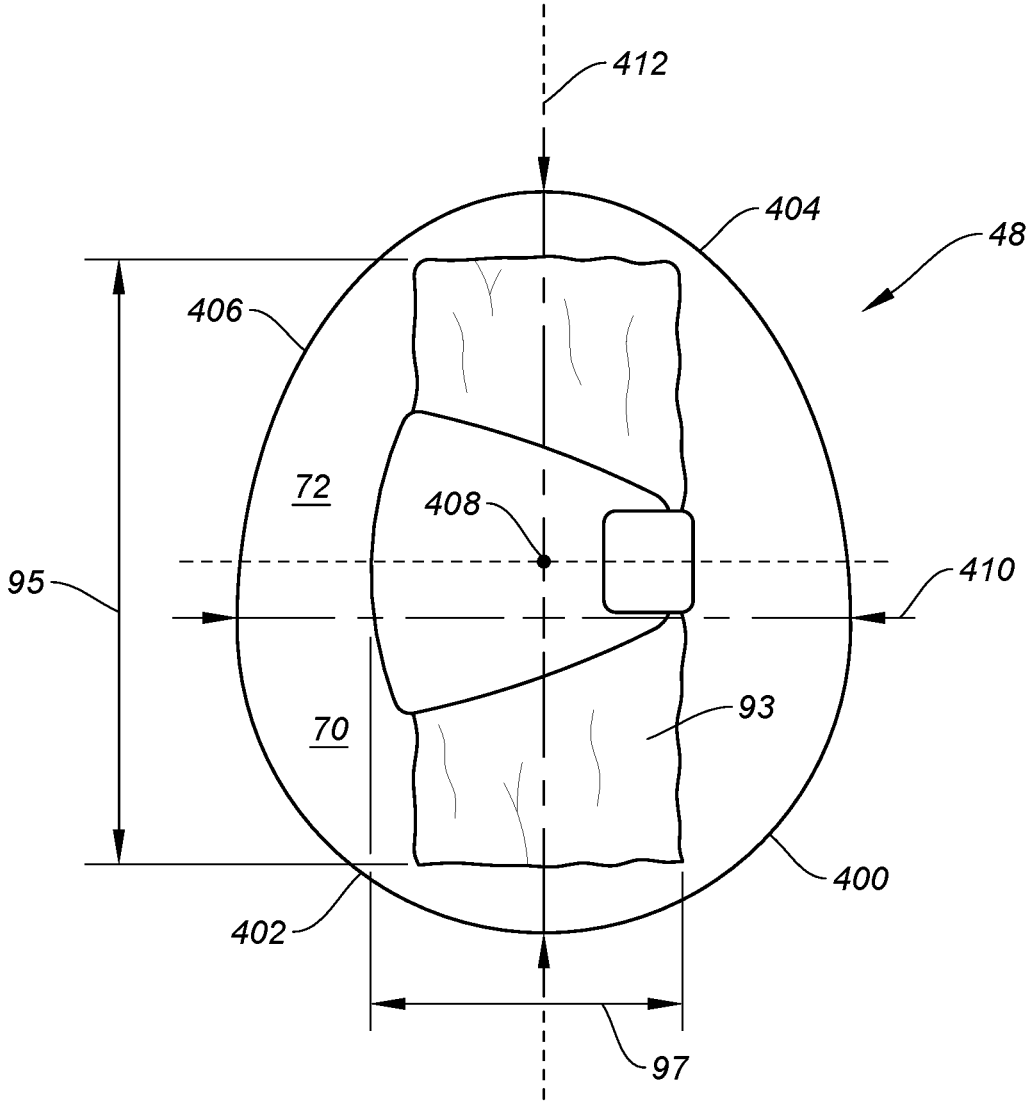
FIG. 15 is a diagrammatic illustration of a cassette central passage with a waste product disposed in the passage.

Many waste disposal devices 22 have a lid 28 that pivots open. Some waste disposal devices 22 are designed such that the lid 28 does not completely pivot aft of the opening for receiving waste. Consequently, the lid 28 can be an impediment to placing the waste within the waste disposal device 22; e.g., the aft portion of the opening through which waste passes may be partially covered by the lid 28, or at least appear to be partially covered by a user standing in front of the device 22. Even those waste disposal devices 22 having a lid 28 that can completely rotate aft of the opening rely on the user (a) fully depressing the foot pedal 30 to achieve the aft lid position, or (b) manually moving the lid entirely out of the way and/or maintaining/holding the lid in that position to avoid the lid being an impediment. If the foot pedal 30 is not completely depressed, the aft portion of the opening through which waste passes can be partially covered. The present cassette 20 addresses this issue by utilizing an ovoid-shaped central passage 48. The ovoid shape provides a large forward widthwise dimension and a longer depthwise dimension, which collectively allows for the deposit of irregularly shaped waste products (e.g., wrapped used diapers 93 that have a first dimension 95 that is longer than a second dimension 97—see FIG. 15) through the center of the central passage 48. The large widthwise dimension (e.g., disposed forward of where it would be with an oval opening) makes it easy to deposit waste packages (including irregularly shaped wrapped diapers) without interference from the lid 28, regardless of whether the lid is completely rotated out of the way. The maximum depthwise dimension increases the ability of the waste disposal device 22 to accommodate irregularly sized waste products. The ovoid-shaped central passage 48 also eliminates forward corners (e.g., corners having an included angle of 90 degrees or less) that can impede the passage of waste. The ovoid-shaped central passage also makes it possible to use currently available liner film 44, and avoids the need for a liner film 44 having a unique cross-sectional (i.e. in the XY plane). geometry.

The present disclosure also contemplates cassettes 20 where the outer geometry of the cassette 20 is ovoid-shaped; e.g., shaped as described with respect to the central passage 48 (see FIGS. 4, 5, and 7). Accordingly, the outer geometry (i.e. outer wall 54, outer edge 55, etc. . . . ) also has a forward edge, an aft edge, a first side edge and second side edge, as well as being defined by an oval and a circle, as described above. Many waste disposal devices have a lid and/or cassette insertion interface (where the cassette is to be inserted and contained within the waste disposal device) that creates consumer confusion regarding the correct orientation of a cassette during insertion. In some cases, as mentioned in U.S. Patent Application Publication No. 2008/0272410 to Mowers et al., known cassettes can be mistakenly installed upside-down. To avoid that error, the present cassette 20 as described herein can assist the user to readily visualize how the cassette should be properly inserted in the waste disposal device. Proper installation of the cassette 20 facilitates proper functioning of the waste disposal device 22 and the benefits that stem therefrom. Accordingly, in some embodiments the outer geometry of the present cassette 20 may be ovoid shaped, and may be received in a cassette interface structure within the waste disposal device 22 configured to mate with the ovoid shape. In some embodiments, the central passage 48 geometry matches the insertion interface of the waste disposal device 22. For instance, the user identifies the peripheral geometry variance of the cassette 20 to determine proper orientation. In some embodiments, both the outer geometry of the cassette 20 and the central passage 48 geometry are ovoid shaped. In some embodiments, the outer geometry of the cassette 20 and the central passage 48 geometry correspond to a similar and/or matching geometry of the insertion interface of the waste disposal device 22.

In further embodiments, the outer edge 55 of the cassette 20 and the central passage 48 geometry may have similarly ovoid geometries (i.e., both are ovoid in shape but different in size and/or precise configuration). The distance between central passage 48 and outer edge 55 (i.e. in the XY plane) may vary along the perimeter of cassette 20 such that there are at least two distances that are different in length. In some embodiments, the central passage 48 has an ovoid that is offset from the ovoid geometry of outer edge 55 (i.e. if both ovoids were centered about each other such that their midpoints 408 were aligned and the inner ovoid was then moved along the widthwise and/or depthwise axis such that the midpoints were no longer aligned) such that the width of the liner cavity 42 varied. In yet other embodiments, the central passage 48 geometry may be different from the outer geometry of the cassette 20 such that one is an ovoid and the other is a different geometry (i.e. curved, curvilinear, a circle, an oval, elliptical, super-ellipse or squircle, a rhomboid, triangular, trapezoidal, polygonal, and combinations thereof). One skilled in the art understands that there are multiple aspects and solutions described and taught in the present disclosure.

the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For instance, in some embodiments, the geometry of the cassette might be rotated or flip-flopped such that maximum distance A is greater than B, and/or distance C is greater than D. Therefore, it is intended that the invention not be limited to the particular embodiment(s) disclosed herein as the best mode contemplated for carrying out this invention.

What is claimed is:

1. A film-dispensing cassette for a waste disposal device, comprising:

a liner cavity for containing a length of liner film; and a central passage surrounded by the liner cavity, the central passage having an ovoid shape;

wherein the central passage has a forward edge, an aft edge, a first side edge, a second side edge, a widthwise axis perpendicular to a depthwise axis;

wherein the widthwise axis extends a maximum distance A between the first and second side edges, and the depthwise axis extends at a maximum distance B between the forward edge and the aft edge, the maximum distance B being the sum of a length of ½A located between the forward edge and the widthwise axis, and a length J located between the widthwise axis and the aft edge, wherein the length B is greater than the length A, and wherein the length J is greater than the length ½A; and wherein the widthwise axis is separated from the forward edge by a distance C, and the widthwise axis is separated from the aft edge by a distance D, where D is greater than C;

wherein the maximum distance A is a maximum widthwise distance;

wherein the maximum distance A is a diameter of an inscribed circle such that a center of the inscribed circle is located the distance J from the aft edge and is within the central passage such that the length ½A is the radius of the inscribed circle;

wherein the widthwise axis is coincident with the maximum distance A; and wherein the depthwise axis is coincident with the maximum distance B and perpendicular to the maximum distance A.

2. The cassette according to claim 1, wherein said cassette is an ovoid shape.

3. The cassette according to claim 1, wherein said cassette is symmetric about said depthwise axis.

4. The cassette according to claim 1, wherein said cassette further comprises an outer wall such that said liner cavity is inward of said outer wall.

5. The cassette according to claim 1, wherein said central passage is offset with respect to said outer wall.

6. The cassette according to claim 1, wherein said cassette further comprises a top panel covering at least a portion of said liner cavity and thereby at least partially containing said liner film.

7. The cassette according to claim 6, wherein said top panel comprises a removal portion.

8. A cassette for a waste disposal device, comprising:

a length of liner film for use in containing and storing waste; and an interior edge that defines a central passage for waste to pass through and into the length of liner film, the central passage having an ovoid shape, the central passage having a forward edge, an aft edge, a first side edge, a second side edge, a widthwise axis perpendicular to a depthwise axis;

wherein the widthwise axis extends at a maximum distance A between the first and second side edges, and the depthwise axis extends at a maximum distance B between the forward edge and the aft edge, the maximum distance B being the sum of a length of ½A located between the forward edge and the widthwise axis, and a length J located between the widthwise axis and the aft edge, wherein the length B is greater than the length A, and wherein the length J is greater than the length ½A; and wherein the widthwise axis is separated from the forward edge by a distance C; and the widthwise axis is separated from the aft edge by a distance D, where D is greater than C; and wherein the maximum distance A is a maximum widthwise distance is a diameter of an inscribed circle having a center of the inscribed circle located the distance J from the aft edge.

9. The cassette according to claim 8, wherein said cassette is an ovoid shape.

10. The cassette according to claim 8, wherein said cassette is symmetric about said depthwise axis.

11. A cassette for a waste disposal device, comprising:

a length of liner film for use in containing and storing waste;

an interior edge that defines a central passage for waste to pass through and into the length of liner film; and an outer edge having an ovoid shape, the outer edge having a forward edge, an aft edge, a first side edge, a second side edge, a widthwise axis perpendicular to a depthwise axis;

wherein the widthwise axis extends at a maximum distance A between the first and second side edges, and the depthwise axis extends at a maximum distance B between the forward edge and the aft edge, the maximum distance B being the sum of a length of ½A located between the forward edge and the widthwise axis, and a length J located between the widthwise axis and the aft edge, wherein the length B is greater than the length A, and wherein the length J is greater than the length ½A; and; and wherein the widthwise axis is separated from the forward edge by a distance C, and the widthwise axis is separated from the aft edge by a distance D, where D is greater than C, and wherein the maximum distance A is a maximum widthwise distance and a diameter of an inscribed circle having a center of the inscribed circle located the distance D from the aft edge.

12. The cassette according to claim 11, wherein said cassette is an ovoid shape.

13. The cassette according to claim 11, wherein said interior edge of said cassette is ovoid shape.

14. The cassette according to claim 11, wherein said cassette is symmetric about said depthwise axis.

15. The cassette according to claim 1, wherein the maximum widthwise distance A is located between the forward edge and the widthwise axis such that a length H between the maximum distance A and the aft edge is a length that is the sum of a length E and the length ½A, such that the length H is greater than the length ½A.

16. The cassette according to claim 15, wherein the cassette has a front region between the forward edge and the widthwise axis, wherein the maximum widthwise dimension is located within a front region, wherein the front region has a front maximum depthwise dimension along the depthwise axis between the forward edge and the widthwise axis equal to the length ½A.

17. The cassette according to claim 16, wherein the cassette has an aft region between the widthwise axis and the aft edge, wherein the aft region has a maximum depthwise dimension along the depthwise axis equal to the length H, wherein the maximum depthwise dimension is greater than the front region maximum depthwise dimension.

18. A film-dispensing cassette for a waste disposal device, comprising:

a liner cavity for containing a length of liner film; and a central passage surrounded by the liner cavity, the central passage having an ovoid shape with a perimeter, a widthwise axis, and a depthwise axis, the perimeter defined by a forward edge, an aft edge, a first side edge, a second side edge, and the perimeter having a first portion disposed on a forward edge side of the widthwise axis and a second portion disposed on an aft edge side of the widthwise axis, the first portion and the second portion collectively form an entirety of the central passage perimeter;

wherein the central passage has a maximum widthwise separation distance between the first side edge and the second side edge coincident with the widthwise axis, the maximum widthwise separation distance equal to a distance A, and the widthwise axis is separated from the forward edge by a distance C that equals one-half the distance A, and the widthwise axis is separated from the aft edge by a distance D, where distance D is greater than distance C;

wherein the central passage has a maximum depthwise separation distance between the forward edge and the aft edge coincident with the depthwise axis, and the maximum depthwise separation distance is equal to a distance B, the distance B is equal to a sum of one-half the distance A and the distance D;

wherein the widthwise axis is a diameter of an inscribed circle having a center located the distance D from the aft edge; and wherein the widthwise axis is perpendicular to the depthwise axis, and the first portion of the central passage perimeter is semicircular shaped.

* * * * *